United States Patent [19]

Lyemance

[11] 3,945,307

[45] Mar. 23, 1976

[54] CHIMNEY DAMPER ARRANGEMENT

[76] Inventor: Bentford C. Lyemance, 502 Wilderness Road, Louisville, Ky. 40216

[22] Filed: Oct. 21, 1974

[21] Appl. No.: 516,178

[52] U.S. Cl. ..... 98/60; 98/59; 98/85; 126/286

[51] Int. Cl.[2] ..... F23L 17/02

[58] Field of Search ..... 98/58–60, 85, 98/45, 67; 126/285, 286, 288, 295; 110/184; 137/601; 49/390

[56] References Cited

UNITED STATES PATENTS

| | | | |
|---|---|---|---|
| 263,898 | 9/1882 | Hallock | 98/60 |
| 535,542 | 3/1895 | Howard | 98/60 |
| 1,563,706 | 12/1925 | Hoffland | 98/59 |
| 1,654,855 | 1/1928 | Bastien | 98/85 |
| 2,704,502 | 3/1955 | Rainey | 98/59 |
| 3,377,939 | 4/1968 | Sailors | 98/59 |

FOREIGN PATENTS OR APPLICATIONS

| | | | |
|---|---|---|---|
| 1,903,323 | 7/1970 | Germany | 98/60 |

*Primary Examiner*—John J. Camby
*Assistant Examiner*—Henry C. Yuen
*Attorney, Agent, or Firm*—Edward M. Steutermann

[57] ABSTRACT

The present invention provides a new and useful arrangement for a chimney cover and damper for the outlet from the flue of a chimney which provides an open frame of substantially rectangular shape to be received on the top of the chimney defining an outlet opening from the chimney having a damper flap cooperatively and pivotably carried by the frame where the frame includes a generally channel shaped lip around the outlet end and the damper flap includes an upstanding lip to be received within the opening defined by the channel member, substantially along the length thereof, to prevent air and water from flowing over the damper flap and into the chimney. The damper flap is advantageously pivoted to assume a normally open position with respect to the frame when unrestrained and closure means which can include chain means are provided and adapted to be attached to the damper flap to pull the damper flap to a closed position with respect to the frame member when the chain is pulled. The invention can include a spring means attached to the damper flap and the chain means to provide a selected tension urging the damper flap toward a closed position when the chain is pulled and can further include a hammer means carried by the chain means to abruptly strike the damper flap on release of the chain means to release the damper flap if it is stuck in a closed position such as when ice, which may tend to hold the damper flap in closed position, has formed between the frame and the damper flap.

7 Claims, 1 Drawing Figure

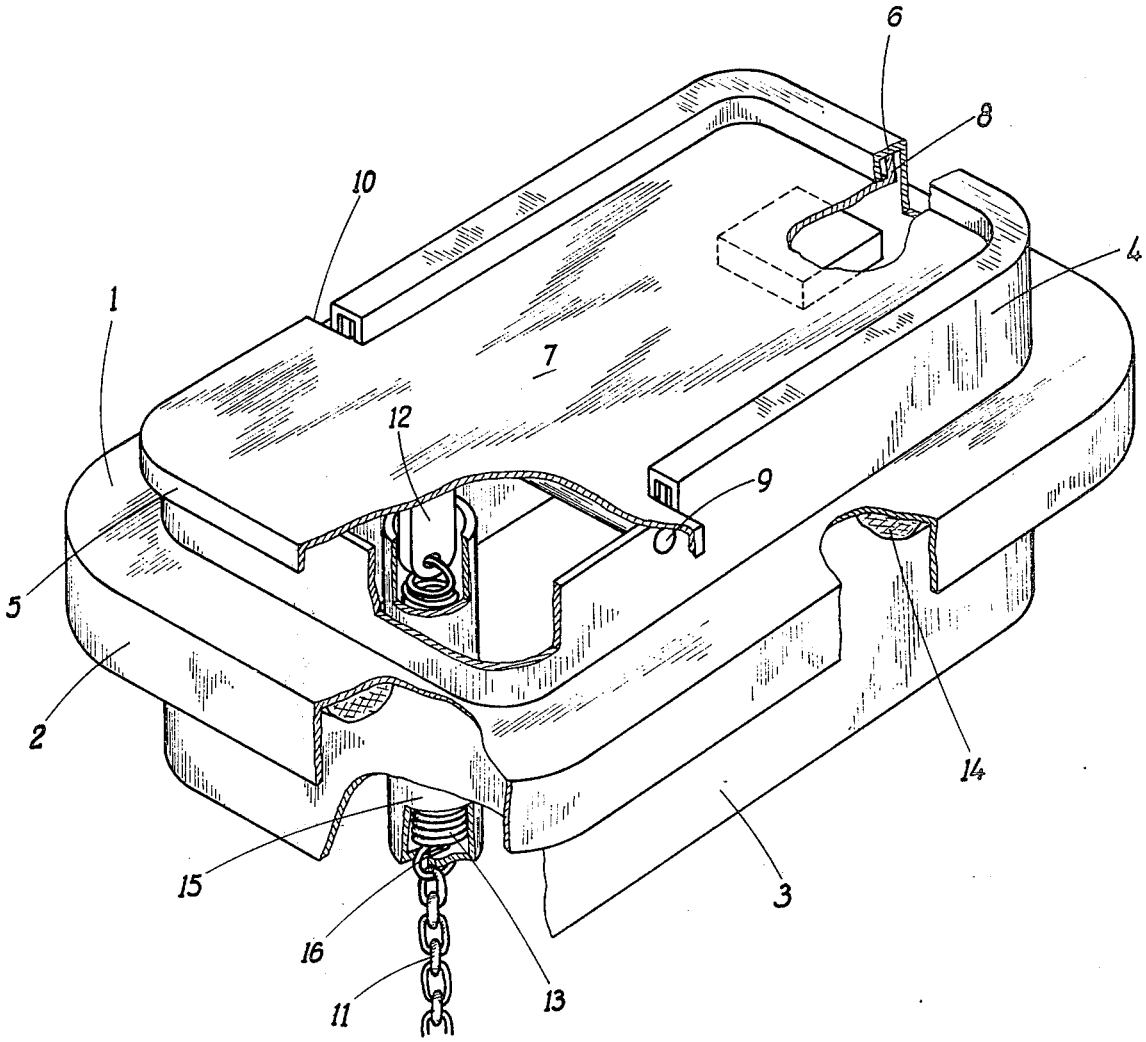
6
8
10
4
1
7
12
9
5
2
14
15
3
16
11
13

CHIMNEY DAMPER ARRANGEMENT

BACKGROUND OF THE INVENTION

It is well known that rain, insects, animals, and birds often enter a home or other building through an open chimney. Further it is well known that severe heat loss occurs through an open chimney during the winter when a damper or other means is not provided to close off the chimney opening when there is not fire in the associated fireplace.

Various means have been provided for closing a chimney or flue when not in use such as the well known fire box damper, and various other prior arrangements. Some such prior arrangements are illustrated in U.S. Pat. No. 2,704,502, RAINEY; and U.S. Pat. No. 2,856,839, SODERBERG, as well as U.S. Pat. No. 3,267,832, HINKLE.

Such prior arrangements have certain disadvantages and it is an object of the present invention to overcome many of the difficulties encountered in the use of the prior art arrangements.

Specifically, such previous arrangements have permitted wind blown rain to enter the chimney even though the damper located at the top of the chimney is closed. Moreover in most such arrangements it has been provided for the damper to be normally closed so that when the means to secure the damper are not functioning the damper is in a closed position and if a fire is built in the fireplace, when the damper is closed, the associated rooms are filled with smoke.

SUMMARY OF THE INVENTION

The present invention provides a damper arrangement to be received by the top of a chimney where a generally rectangular frame is provided defining an opening from the chimney and having a substantially U-shaped inwardly turned channel member around a portion of the opening defined by the frame to receive an upstanding lip of an associated damper flap which is pivotably mounted on the frame. The arrangement prevents wind blown rain from entering the chimney and likewise prevents a common difficulty encountered with previous arrangement namely the situation where the damper flap is frozen closed during cold weather and cannot be opened. Furthermore the present invention provides an arrangement where the damper flap is pivotably mounted on the frame member to be retained in a normally opened position so that in the event of failure of the means provided to close the damper flap, the damper flap moves to an open position.

Moreover, the present invention can provide the chain means connected to the damper flap by means of a spring. By pulling the chain when the damper flap is closed a selected tension can be securely retained to provide the damper flap when the chimney is not in use.

Likewise, the present invention can advantageously provide a cooperative hammer means which can be carried by the chain so that when the spring is extended the chain is released the force of the spring causes the hammer means to abruptly strike the damper flap to release the flap in the event it is lodged in closed position.

BRIEF DESCRIPTION OF THE DRAWING

FIG. 1 shows a perspective view partly in section of one example of a damper in accordance with the present invention as described hereinafter.

The example of the present invention shown in the FIGURE, includes a generally rectangular frame member 1 which is provided to rest on the top at the outlet of the flue of a chimney (not shown) in which the damper arrangement is installed. A depending flange 2 can be provided to extend downwardly from frame 1 over the outer surface of the chimney flue. Frame 1 likewise includes an upstanding generally rectangular flange 4 provided with an inverted channel member 6 at the top edge thereof, which extends partially around the periphery of flange 4 as shown. A sleeve 3 can be provided, as shown, to extend downwardly into the flue liner adjacent the walls of the chimney.

As shown, damper flap 7 is provided to be pivotably mounted in cooperation with flange 4 for example by means of a pivot 9. Pivot 9 is advantageously journaled, for example in flange 7 so that when damper flap 7 is unrestrained, the damper flap is rotatable in a clockwise direction out of engagement with channel 6 to open generally vertical position exposing the opening defined by flange 4 and opening the chimney flue, a weight 17 can be provided to provide additional force tending to open flap 7.

As shown, damper flap 7 includes a downwardly extending lip 5 which can, advantageously extend substantially around a portion of damper flap 7 which extends beyond the limits of flange 4. An upstanding flange 8 is provided around a portion of the periphery of flap 7 to be received in channel 6 to provide a seal between flange 4 and damper 7 extending substantially around flange 4 and the periphery of damper 1 from one end of pivot 9 to the other.

An arm 12 can be provided on the underside of flap 7 to be connected to a chain 11 by means of a spring 13. Chain 11 extends downwardly to the chimney to fireplace associated with the chimney for closing damper 7 and can be retained therein by latch means (not shown).

Spring 13 is provided among other purposes to provide a selected tension when chain 11 is pulled after damper 7 is closed, to provide additional basis to hold damper 7 in a closed position and securely fasten damper 7 when chain 11 is pulled to extend spring 13.

In accordance with another advantageous feature of the present invention a hammer means, for example a cup 15, can be provided adjacent the upper end of chain 11. In the example shown the end of spring 13 extends through a slot 16 provided in cup 15 and the end of spring 13 extending through slot 16 is adapted to be attached to chain 11. Cup 15 can advantageously, be of a selected weight so that when chain 11 is pulled, to extend spring 13, and then released, cup 15 abruptly strikes the underside of damper flap 7 to urge damper 7 in a clockwise direction (as view in the drawing) to disengage damper flap 7 from flange 4.

This arrangement is particularly useful in cold weather when moisture may have accumulated between damper 7, and flange 4 and particularly between upstanding lip 8 and channel lip 6 and frozen to damper 7 in a closed position.

In accordance with another feature of the present invention a sealing compound 14 can be provided on the underside of frame 1 between flange 2 and sleeve 3 to seal the underside of flange 1 to the top of the chimney to which the apparatus is placed. In the alternative bolts (not shown) can be provided to extend through cooperative openings in sleeve 3 and fastened to the chimney flue to secure the damper arrangement in place.

In operation, frame 1 is received on the chimney to which the damper arrangement to be installed, with flanges 2 extending downwardly along the outer surface of the chimney while sleeve 3 is received by the flue defined within the chimney.

Damper flap 7 is previously described is normally open, and is closed by pulling spring 11 and fastening the spring to suitable fastener means and which is located within the fire box in the fireplace (not shown).

As further previously described, chain 11 can then be pulled further to extend spring 13 to provide a resultant force urging damper flap 7 into closed position.

Upon release of chain 11 damper flap 7 is then rotated by gravitational force resulting from the location of pivots to an open position extending generally vertically into collar 3 and the chimney flue so that the flue is open and ready for use. It will be noted that in the event spring 11 breaks damper flap 7 will always "fail safe" by rotating to an open position so that the chimney is available for use. In arrangements where the damper is opened by pulling a chain or similar means considerable difficulty is experienced when the chain breaks so the damper return to normally closed position. Extreme difficulties arise when the opening means break after a fire is already set in the associated fireplace.

It will be further noted that the arrangement described herein in accordance with the present invention provides an arrangement, most notably lip 5 and cooperative flange 8 received by channel 6 to prevent air blown water from entering the chimney by leakage around the outer surfaces of the flange 7.

Moreover in the event water accumulates on the upper surface of flange 7 and freezes damper flap closed, chain 11 can be drawn to extend spring 13 where the chain is then released so hammer 15, as previously described strikes the underside of damper flap 7 to urge the damper flap to open position. On some occasions, successive repetition of the procedure may be required to break the damper flap loose.

It will be recognized that various other arrangements in accordance with the present invention will occur to those skilled in the art upon reading the disclosure set forth hereinbefore. Accordingly, the scope of the present invention is to be limited only by the claims appended hereto.

The invention claimed is:

1. A chimney flue damper and closure arrangement including:

a. frame means of substantially rectangular shape to be disposed within the outlet from a chimney flue to define an outlet from said chimney flue;

b. sleeve means extending downwardly from said frame means into said flue;

c. damper flap means pivotably carried by said frame means to rotate from a first position closing said outlet defined by said frame means to a second position wherein a first portion of said damper flap means is disposed within said chimney flue and a second portion of said damper flap means of lesser mass than said first portion is rotated to extend outwardly from said frame means so said outlet defined by said frame is open to flow of fluid from said chimney flue;

d. first and second pivot means connected to said damper flap means and said frame means to pivotably connect said damper flap means to said frame means;

e. upstanding lip means carried around a portion of the periphery of the first portion of said damper flap to extend generally laterally from said damper flap;

f. downwardly opening channel means carried by said frame means around a portion of said outlet defined by said frame means to receive said upstanding lip means of said damper flap means to provide seal means when said damper flap is in said first position.

2. The invention of claim 1 wherein:

a. an underside of said second portion of said damper flap is adapted to engage an outlet edge of said frame means and second portion of said damper flap means extends beyond the periphery of said portion of said frame means engaged by said second portion of said damper flap means; and b. said second portions of said damper flap includes downwardly extending lip means around a portion of said second portion of said damper flap.

3. The invention of claim 1 wherein said first portion of said damper flap means is heavier than said second portion of said damper flap means so said first portion of said damper flap, when unrestrained rotates about said pivot means to open the opening defined by said frame means.

4. The invention of claim 3 including control means to selectively close said damper flap means.

5. The invention of claim 4 wherein said control means include chain means connected to said second portion of said damper flap means and extending through said chimney flue to selectively close said damper flap means when said chain is pulled.

6. The invention of claim 5 wherein said chain means are connected to said second portion of said damper means by extensible spring means so that by pulling said chain means and extending said spring means said second portion of said damper flap means is urged to tightly engage said frame means.

7. The invention of claim 6 including hammer means carried by said spring means to abruptly strike said second portion of said damper flap means when said spring means is extended and released.

* * * * *